US008485556B2

(12) United States Patent
Shaheen

(10) Patent No.: US 8,485,556 B2
(45) Date of Patent: Jul. 16, 2013

(54) ACCESSORY SYSTEM FOR A GLIDE BOARD

(76) Inventor: Paul Shaheen, Hermosa Beach, CA (US)

( * ) Notice: Subject to any disclaimer, the term of this patent is extended or adjusted under 35 U.S.C. 154(b) by 0 days.

(21) Appl. No.: 13/026,042

(22) Filed: Feb. 11, 2011

(65) Prior Publication Data

US 2011/0198833 A1 Aug. 18, 2011

Related U.S. Application Data

(60) Provisional application No. 61/337,859, filed on Feb. 12, 2010.

(51) Int. Cl.
*A63C 11/00* (2006.01)
*B63B 1/00* (2006.01)

(52) U.S. Cl.
USPC ..... 280/809; 441/65; 441/64

(58) Field of Classification Search
USPC ..... 280/14.21, 14.22, 608, 609, 610, 280/809, 822, 825, 87.02, 814, 816, 633, 280/636, 14.2; 248/686; 441/65, 74, 75
See application file for complete search history.

(56) References Cited

U.S. PATENT DOCUMENTS

| | | | | |
|---|---|---|---|---|
| 1,542,850 | A | 6/1925 | Curtis et al. | |
| 3,179,433 | A | 4/1965 | Flack | |
| 4,955,835 | A * | 9/1990 | Hollingsworth | 441/74 |
| 5,356,324 | A * | 10/1994 | Cunningham | 441/79 |
| 5,769,445 | A * | 6/1998 | Morrow | 280/610 |
| 5,794,463 | A | 8/1998 | McDaid | |
| 5,816,602 | A | 10/1998 | Hayashi | |
| 6,139,035 | A | 10/2000 | Tsai | |
| 6,428,032 | B1 | 8/2002 | Humbel | |
| 6,983,941 | B2 | 1/2006 | Moscaret et al. | |
| 6,991,504 | B1 * | 1/2006 | English et al. | 441/79 |
| 2004/0036257 | A1 | 2/2004 | Lille et al. | |
| 2004/0145152 | A1 * | 7/2004 | Santa Cruz et al. | 280/602 |
| 2004/0212980 | A1 * | 10/2004 | Wells | 362/31 |
| 2005/0225042 | A1 | 10/2005 | Liu | |
| 2006/0237921 | A1 | 10/2006 | Shaheen | |
| 2007/0066144 | A1 | 3/2007 | Jackson et al. | |
| 2007/0278753 | A1 * | 12/2007 | Candler | 280/14.22 |

FOREIGN PATENT DOCUMENTS

| | | |
|---|---|---|
| CH | 692972 | 1/2003 |
| DE | 102004016264 | 10/2005 |
| DE | 202006004949 | 6/2006 |
| EP | 852157 | 7/1998 |

* cited by examiner

*Primary Examiner* — John Walters
*Assistant Examiner* — James Triggs
(74) *Attorney, Agent, or Firm* — George P. White

(57) ABSTRACT

A snowboard or other glide board has a receptacle and plug accessory system for quickly incorporating additional and interchangeable functionality to the board. A user can readily switch functionality in and out of the board by way of the plug and receptacle system. Various plugs contain different features. The receptacle can be incorporated during manufacturing, such as in a manner compatible with existing manufacturing practices, as a retrofit to existing boards. The receptacle is a plate embedded into the board, in line with the core and sandwiched between the strength layers that are typically comprised of fiberglass. The receptacle sidewall has a one side of a latch mechanism in its interior walls. In one implementation, the plug accessory can latch fit into the receptacle. The plug can be disengaged with one hand without tools. The plug accessory can incorporate a camera, a light, a flag, and a rooster tail duct.

25 Claims, 13 Drawing Sheets

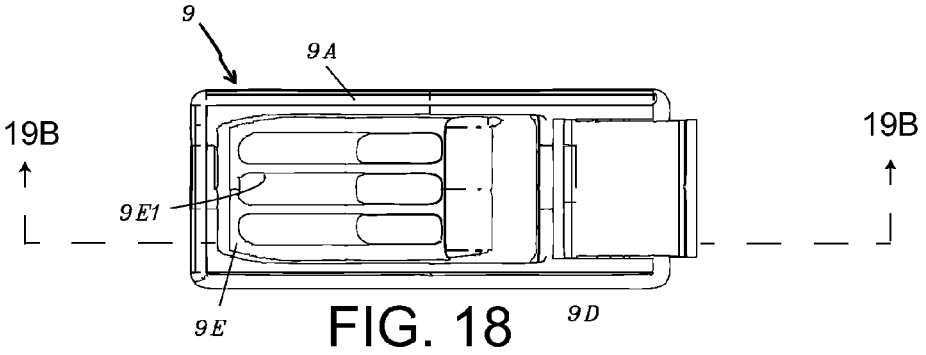
FIG. 18
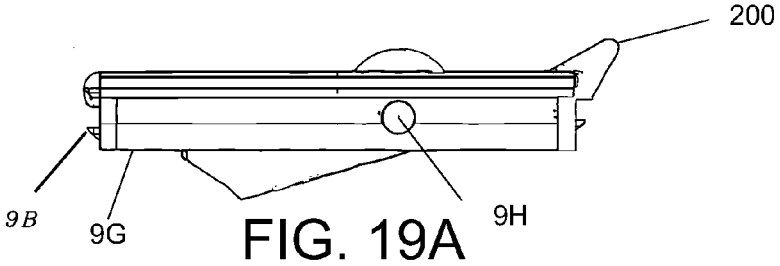
FIG. 19A
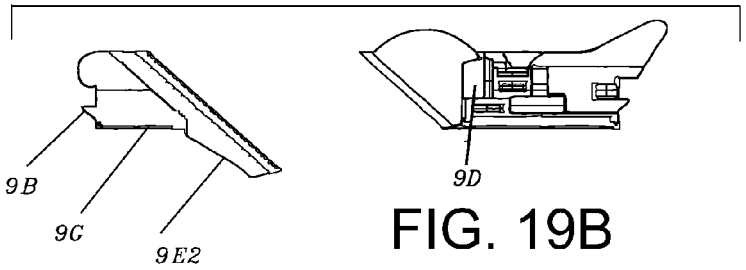
FIG. 19B
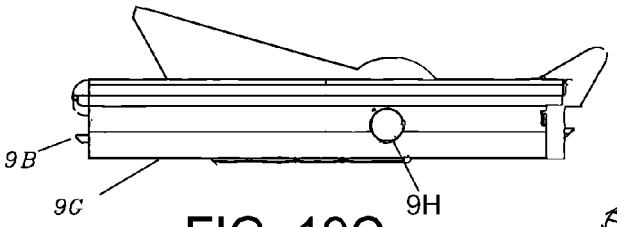
FIG. 19C
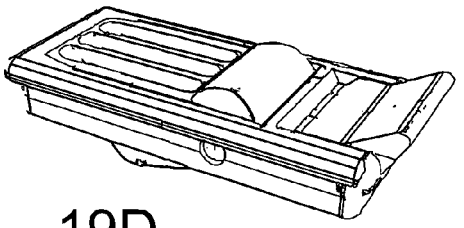
19D

ACCESSORY SYSTEM FOR A GLIDE BOARD

CROSS-REFERENCED APPLICATION

This application claims priority benefit from, and hereby incorporates in full by reference, the provisional application Ser. No. 61/337,859 with a filing date of Feb. 12, 2010 by the same inventor, Paul Shaheen "ACCESSORY SYSTEM FOR A SNOWBOARD."

FIELD

Embodiments of the invention relate to accessory systems for added functionality for glide boards including snowboards, skis, wakeboards, and other boards.

BACKGROUND

Snowboards and other glide boards range from simple, predominately planar structures to sophisticated units with active dampening capability. Snowboarding is a growing popular sport and pastime with many participants who strive to enhance and personalize their experiences. There is a lack of accessories and systems for incorporating accessories into snowboards and other glide boards.

SUMMARY OF THE INVENTION

The problem of a convenient accessory system for snowboards and other glide boards is solved with a universal receptacle and plug system for quickly incorporating additional and interchangeable functionality to the board. In some embodiments of the universal receptacle and plug accessory system, a user can readily switch features in and out of the board by way of the herein described universal plug and receptacle system.

Various plugs containing different features may be made available for purchase in the retail market. The receptacle can be incorporated into the board during manufacturing, such as in a manner compatible with existing manufacturing practices, or as a retrofit to existing boards. In one embodiment, the receptacle may be comprised of a plate embedded into the board, such as in line with the core and sandwiched between the strength layers that are typically comprised of fiberglass. The receptacle may be configured to have a thru hole penetrating the top and bottom planes of the board, and can contain the female moiety of a latch fit to the interior walls. This would provide for plug accessory fitting into the receptacle in a positive-locking manner.

The plug accessory can have the male side of latch components in which one or both of the male latch contracts, such as via a spring-action button, lever, and/or the like to allow seating into the receptacle. Upon release of the button, the male latch retracts into the female latch portion of the receptacle, effectively locking the plug into the receptacle. A secondary lock may be employed in some implementations. In some embodiments the male portion of a latch can be located on the receptacle while a retractable female latch portion can be on the plug. The plug accessory is the housing that contains additional desired features, performance enhancing or otherwise, independently or in tandem with the receptacle in the board. Some versions can have a plug that is inserted from below, by having a trapezoidal shape, while others can be circular and fit in from the top by a screw or bayonet mount.

BRIEF DESCRIPTION OF THE DRAWINGS

Illustrative embodiments in accordance with aspects of the invention are described in connection with the following drawings, in which like numerals reference like elements, and wherein:

FIG. 18 is a plan view of one embodiment of a plug portion that implements a rooster tail and stabilizing effect; the gaps are through-holes through the plug to the snow below;

FIG. 19A is a side view of the plug of FIG. 18; the rooster tail duct is seen deployed and extending below the bottom surface of the plug;

FIG. 19B is a side, cross-sectional view the plug of FIG. 18 along the lines 19B-19B; the rooster tail duct is deployed and the through-path is illustrated;

FIG. 19C is a side view of the plug of FIG. 18; with the rooster tail duct retracted;

FIG. 19D is a perspective view of the unit of FIG. 18;

FIG. 30 shows a handle grip for use in additional tricks performed during riding or for carrying the board;

FIG. 31 shows a still shot camera or video camera;

FIG. 32. shows a flag for identification during riding or for additional personalization;

FIG. 33 shows a spotlight or other light;

DETAILED DESCRIPTION

Figure 1:
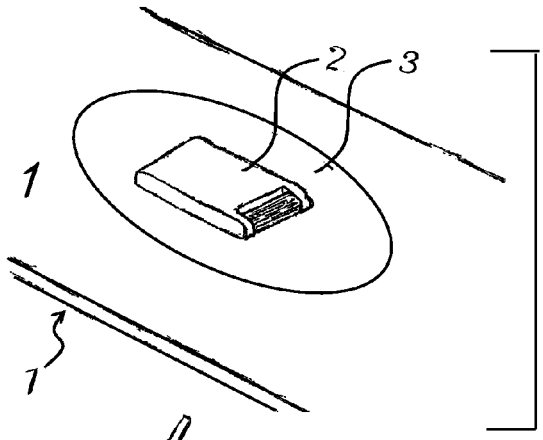
FIG. 1 is an isometric view of a portion of a glide board showing one embodiment of a plug engaged in a receptacle.

In conjunction with the included drawings this detailed description is intended to impart an understanding of the teachings herein and not to define their metes and bounds. Described herein are embodiments and implementations of universal systems, apparatuses, and methods for adding a plurality of functionality to a glide board. In one embodiment, a plug and receptacle is described in which the plug contains the added functionality and the receptacle is embedded in the board and includes structures to accept the plug. In one embodiment of the invention, the receptacle may be embedded in the board during the manufacturing process. The receptacle may be made of plastic, metal, and/or other materials. The receptacle may be located in the core, which is usually made of wood, and sandwiched between the strength-layers of a typical glide board, that are usually layers of fiberglass. The receptacle may have a thru-hole that penetrates the top and bottom planes of the board. The receptacle may have two notches, located on opposite interior walls that would serve as female to a latch in the plug. The plug may fit into the thru hole of the receptacle and have male latch tabs to mate securely into the female latch accepting notches of the receptacle wall.

A board specific spacer may be attached to the top of the board above the receptacle, and may maintain universality of the plug with a plurality of board thicknesses, board contours, and possible receptacle mounting locations. In another embodiment of the receptacle, the aforementioned receptacle may also contain electrical connections configured to mate with like electrical connections on the plug and therefore, when the plug is installed, the assembled parts form a closed circuit between the receptacle and the plug, allowing the electronics to communicate between the components. This would allow for a variety of functionality such as, but not limited to, a power source (e.g. battery, solar, or other) located on the board to power an electrical device in the plug (e.g. spot light or other). In another embodiment of the invention, the receptacle may be retrofitted into an existing snowboard. The existing board may be routed or machined to create a cavity for the receptacle to fit into. The retrofit receptacle may be adhered to the cavity by way of an all-weather adhesive or other adherence. The retrofit receptacle may be comprised of a plate as described in the preferred embodiment. The bottom of the plate may have a layer of material similar to the base layer of the glide board. In one implementation, the retrofit receptacle may be of a thickness to accommodate the universal plug without need for a spacer.

In one embodiment of the invention, the plug may be comprised of a main housing, and two male tabs located on either end of the housing. One male tab may be retractable by way of a spring-loaded button, lever, or the like. The bottom of the plug may be a layer of material similar to the base of the gliding board. The plug may contain the added functionality within its housing, alone or in tandem with the receptacle and the board. The plug may be made of plastic, metal, and/or other material. In another embodiment of the invention, the aforementioned plug may also contain electrical connections such as may be configured to mate with like electrical connections on the receptacle and therefore, when the plug is installed, the assembled parts form a closed circuit between the receptacle and the plug, allowing the electronics to communicate between the components. This allows for a wide variety of functionality such as, but not limited to, a power source (e.g. battery, solar, or other) located in the receptacle or on the board to power an electrical device in the plug (e.g. spotlight or other). In other embodiments of the plug, the latch fittings can be located on the sides of the plug and receptacle housing, instead of and/or in addition to longitudinally. The retractable male latch can also be part of the housing and retract by way of linear elastic deformation similar to a latch mechanism. Embodiments of the invention can enhance the glide board with a plurality of additional functionality.

The examples described herein are included for illustrative purposes, and the entirety of functionality made possible by embodiments of the invention is not limited to those examples described herein. In one aspect of the invention, the plug functionality may be a rooster tail and stabilizing effect by way of a retractable duct that penetrates the gliding surface of the board and collects and disperses the medium upward. The portion of the duct that penetrates the lower surface of the glide board may be shaped in a way, such as using fillets and chamfers, so that it is retractable if incidental force is applied at any angle by way of hard ice, park features such as rails, boxes, and/or the like, or if the rider is traveling in a direction opposite the normal retraction direction of the duct. In one implementation, this duct may also be configured to be manually retractable, such as by way of cam acting on the duct and activated by a rotating lever arm used to raise and lock the duct to the retracted position. The duct contour may also be of a unique shape allowing the duct to create an equally unique medium dispersion effect. The duct could, in one implementation, be nozzled (e.g., tapered inward, upward) such that the medium increases velocity while in the duct and thus disperses to a higher apex. In another aspect of the invention, the additional functionality may be a stabilizing effect by way of a retractable fin that penetrates the gliding surface of the board in the riding medium and adds stability. It is well known that the lower surface of a glide board is preferably of a material with a low coefficient of friction with the substance to glide upon. In the case of a snowboard, the low surface is of a material with a low coefficient of friction with snow and also with a low water absorption property. Some currently used material provides a coefficient of friction of about 0.04. By an effectively low coefficient of friction, it is meant one that is low enough for use as a glide board on an intended surface.

In another aspect of the invention, the plug may contain the additional functionality of a leash that may be configured to be held by hand and/or strapped to a boot or leg. In another aspect of the invention, the additional functionality may be that of a handle grip, such as for use in additional tricks performed during riding, for carrying the board over-the-shoulder while walking, and/or the like. In another aspect of the invention, the additional functionality may be that of a still shot camera, video camera, and/or the like that, in some implementations, may be vibration and/or shock isolated to prevent damage and stabilize the filming during riding. In another aspect of the invention, the additional functionality may be that of a flag, such as for identification during riding or for additional personalization.

The personalization functionality could also be a plate on the plug, such as that depicts a graphic, logo, or other of the riders' favorite group, club, organization, sports team, and/or the like. In another aspect of the invention, the additional functionality may be that of a spotlight or other light, such as for use during night riding that can light the way and allow the rider to be seen by other riders. The light may be self-powered by its own local source, or it may be powered by way of a power source located on the glide board with electrical current sent to power the light through electrical connections between the plug and receptacle. FIG. 1 is an isometric view of an illustrative embodiment of a section of a glide board 1 that incorporates several of the aspects of the invention described above.

Figure 2:
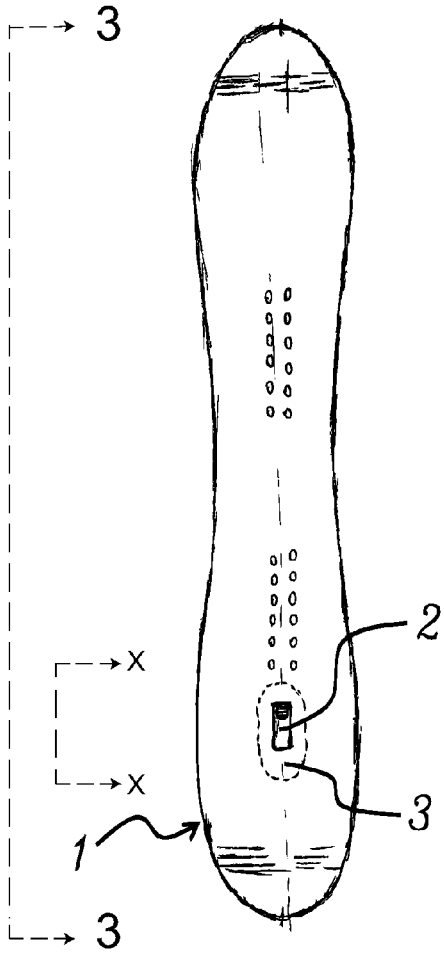
FIG. 2 is a top view of the glide board, which in this view is a snowboard, showing an embodiment of the plug installed with the outline of the embedded receptacle shown as visible.

A variety of different illustrative embodiments are described herein that incorporate various different aspects, and are not limited to the illustrative embodiments described below. Referring more particularly to the drawings, a glide board 1 is shown in FIG. 1 with the plug 2 portion installed into the receptacle plate 3 portion. The receptacle plate 3 is shown as it is embedded into the glide board 1. Generally there would be a top surface layer of the board that would hide this oval line. The plug 2 shown in FIG. 1 may depict an embodiment that has a flat bottom that is flush to the bottom plane of the glide board 1, and may not have internal electrical functionality. FIG. 2 shows a top view of the glide board 1, which in this case is specifically a snowboard 1, with the plug 2 portion installed into the receptacle plate 3 portion. The plug 2 and receptacle 3 may be located at any location and/or position on the snowboard 1.

Figure 3:
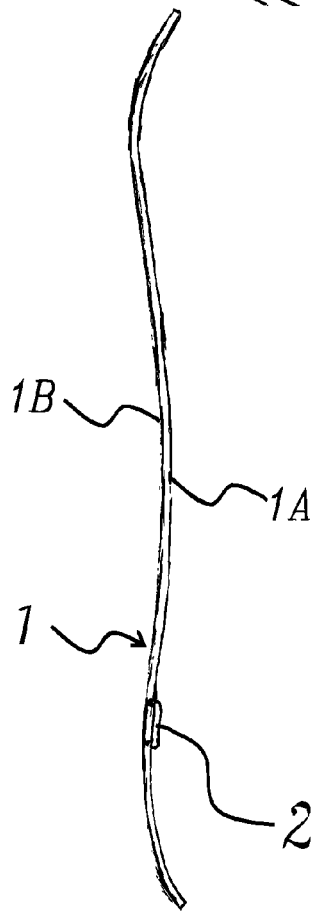
FIG. 3 is a side, cross-section view of the glide board along the lines 3-3, showing an embodiment of a plug installed in a board.

There could also be multiple of plug 2 and receptacle 3 combinations on the snowboard 1, such as one at either end of the board. FIG. 3 shows an implementation that penetrates the top 1A and bottom 1B of the snowboard 1. The bottom of the plug 2 embodiment may have a layer of material the same as the bottom 1B of the snowboard 1 that is usually made of polyethylene. This maintains that the gliding surface of the snowboard 1 or other glide board has a continuous low friction bottom 1B surface to minimize drag.

Figure 4A:
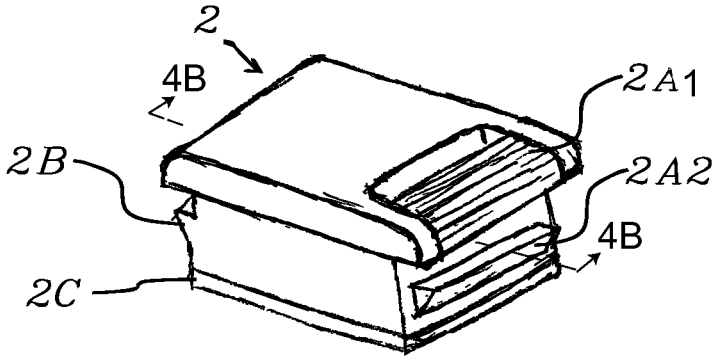
FIG. 4A is an isometric view of one embodiment of a basic plug.
Figure 4B:
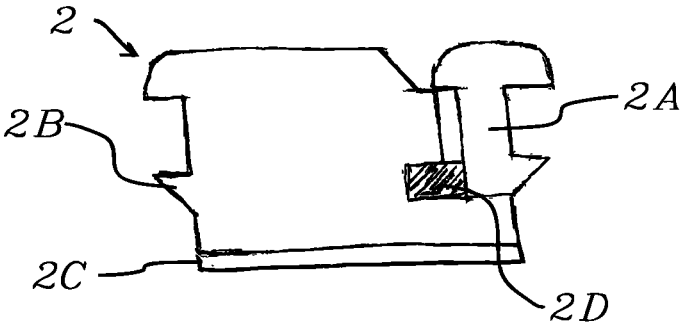
FIG. 4B is a side view of the unit of FIG. 4 along the lines 4B-4B.
Figure 4C:
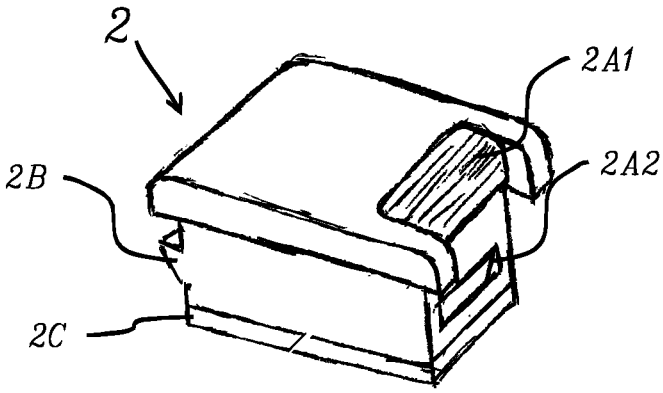
FIG. 4C is the view and unit of FIG. 4A with the male latch in a retracted state.

In FIGS. 4A-4C, the plug 2 has two male tab features 2A and 2B, one latch fit 2A2, which is retractable by a button 2A1. The counterforce spring 2D maintains the male retractable latch in the shown open position. To install the plug 2 into the receptacle 3 in FIG. 1, the user may depress the button 2A1, and insert the plug 2 into the receptacle 3. The counterforce spring 2D maintains the retractable male latch 2A2 in the open position, thus acting as a locking mechanism when the plug 2 is installed in the receptacle 3. Removal of the plug 2 may be performed in the same or a similar manner as installation. In one implementation, the base layer 2C may be affixed to the housing of the plug 2 using an industrial strength all-weather adhesive, ultrasonic welding, and/or other method of bonding.

FIG. 4B shows a cross-section side view of FIG. 4A along the line 4B-4B of an embodiment of the plug 2, and better illustrates the reaction of the counterforce spring 2D bearing against the retractable male latch 2A. FIG. 4C shows an isometric view of an embodiment of the plug 2, and depicts the retractable male latch 2A2 in the retracted position and ready for installation or removal from the receptacle 3 of FIG. 1.

Figure 5:
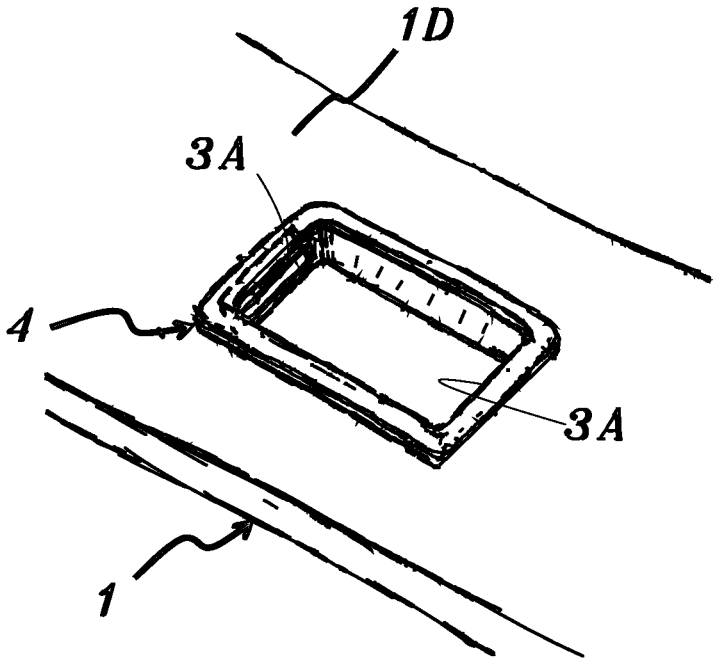
FIG. 5 is an isometric view of an embodiment of an embedded receptacle shown installed in a glide board without a plug installed.
Figure 6:
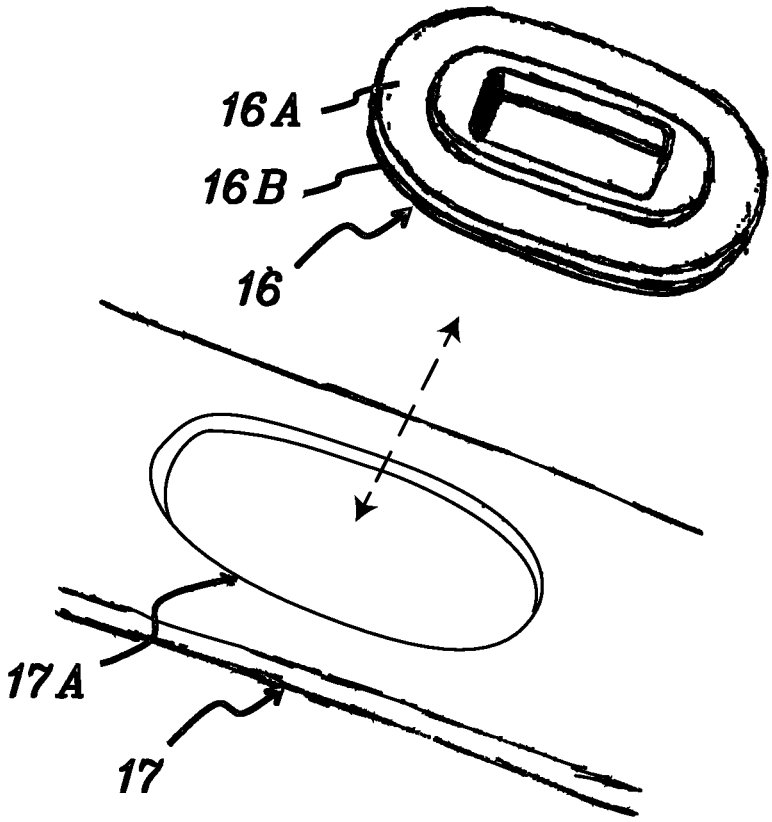
FIG. 6 is an isometric view of a portion of a glide board showing one embodiment of a receptacle portion exploded and portrays installation to an existing glide board as a retrofit.

FIG. 5 depicts the receptacle 3 portion without the plug 2 installed. In FIG. 6 an exploded view of a receptacle, going in to retrofit a board is seen. The sides of the receptacle wall have recesses or notches to provide the female mating moiety to the plug's tabs. A receptacle cavity 17A may be bored out of the existing glide board 17 using a router or standup mill that may accept the retrofit receptacle 16. The retrofit receptacle 16 may be adhered to the existing glide board 17 using industrial strength adhesive and/or other method of attachment. The base material 16A of the retrofit receptacle 16 which may be the same material as the base of the retrofit glide board 17 may be attached using industrial strength adhesive, ultrasonic welding, and/or other method of attachment.

Figure 7:
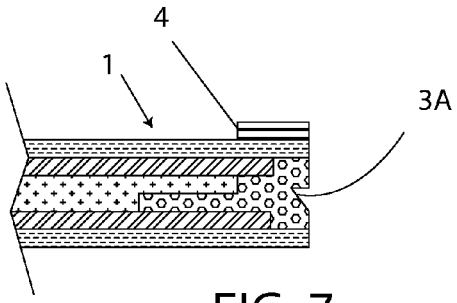
FIG. 7 is a side, cross-section view of the configuration of FIG. 2 along the lines X-X.
Figure 8:
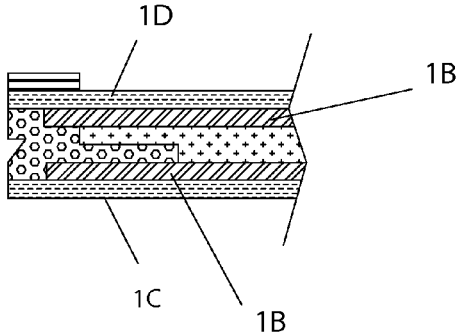
FIG. 8 is the view of FIG. 7 with a plug installed.

The cross sectional views along the line X-X of FIGS. 7 and 8 show the mating details of a plug and receptacle example. The female recesses 3A as shown are in line to the longitudinal axis of the glide board and may accept the male tabs of the plug 2 depicted in FIG. 4A. The board specific spacer 4 may adhere to the top layer 1D of the glide board 1 and may be configured to take up any thickness differences between the plug 2 and the top layer 1D of the glide board 1. FIG. 8 depicts one embodiment of the plug 2 configured to occupy the receptacle 3 of FIG. 5 and the bottom 2C is flush to the bottom of the snowboard 1B from FIG. 8 creating a continuous bottom surface. This allows the snowboard 1 to behave in a usual manner with no additional functionality.

A more detailed discussion of FIG. 7 and FIG. 8 include: FIG. 7, which is a side cross-section view of a snowboard 1 with the embedded receptacle 3, embedded in a machined or routed out cavity in the core 1C, and installed between the fiberglass layers 1B and the base layer 1C on bottom and the top graphical layer 1D, on top. In some layered glide board manufacturing processes, the layers of the glide board 1 are stacked one by one from the bottom up, and resin is spread over each successive layer. The "wet" resin inlayed assembled board is then put under pressure and temperature for a specific period of time to allow for curing. A receptacle 3 portion may, in some implementations, be embedded in the glide board 1 during the aforementioned layering process, may be configured without additional protrusions above, or below the top and bottom layers of the glide board 1, and therefore may be fully compatible with existing manufacturing processes. From FIG. 7, a further component of this embodiment of the invention is the board specific spacer 4, which, in one implementation, may be adhered to the glide board 1 after the assembly, and may not be included during the curing process.

Figure 9:
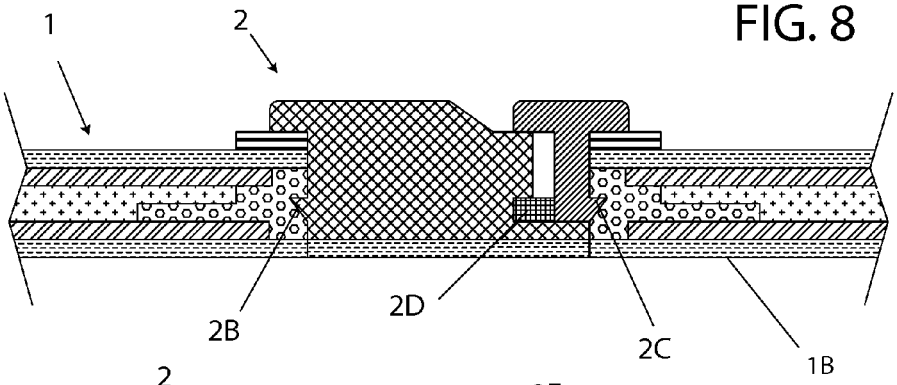
FIG. 9 is the view of FIG. 8 but of a unit having electrical contacts in the board, the receptacle, and the plug.
Figure 9:
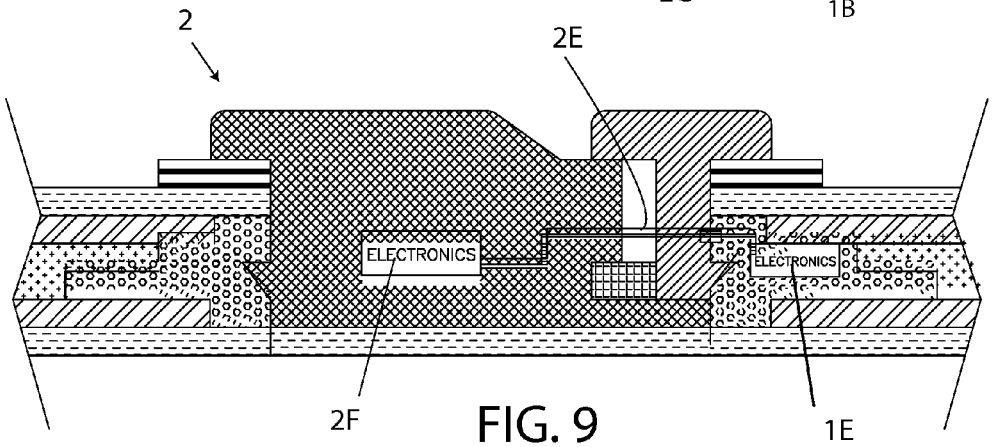

Glide boards 1 are of various thicknesses across the length of the board and across board styles and manufacturers. The board specific spacer 4 may adhere to the top layer 1D of the glide board 1 and may be configured to take up any thickness differences between the plug 2 and the top layer 1D of the glide board 1. The board specific spacer 4 allows the plug 2 to be universally used across all thicknesses of the board and various board manufacturers. Therefore, a single interfacing geometry of the plug 2 may be provided that is compatible with all glide boards that have the incorporated receptacle 3, and therefore effectuate the universality of the invention. The spacer 4 may, in some implementations, be made be of plastic or other material. In one implementation, the geometry could be rectangular in shape where an inner, open perimeter would allow for the plug 2 to be properly installed into the receptacle 3. In FIG. 8 the plug 2 is depicted installed in the receptacle 3 where the male latch tabs 2B and 2C fit into the female notches 3A from FIG. 7, and are locked by the counterforce spring 2D. The portion of the invention that is the board specific spacer 4 is shown adhered to the top of the snowboard 1 and sandwiched below the plug 2. An example of the extension to the embodiment of FIG. 7 and FIG. 8 is shown in FIG. 9 and includes an electrical connection 2E between the plug 2 and the receptacle 3. This may interface electrical components 2F, such as a microprocessor, power source, and/or data acquisition equipment, installed in the plug 2 with electrical components 1E that are installed in the receptacle 3 and/or the glide board 1.

Modular Plug Base and Insert

Figure 10:
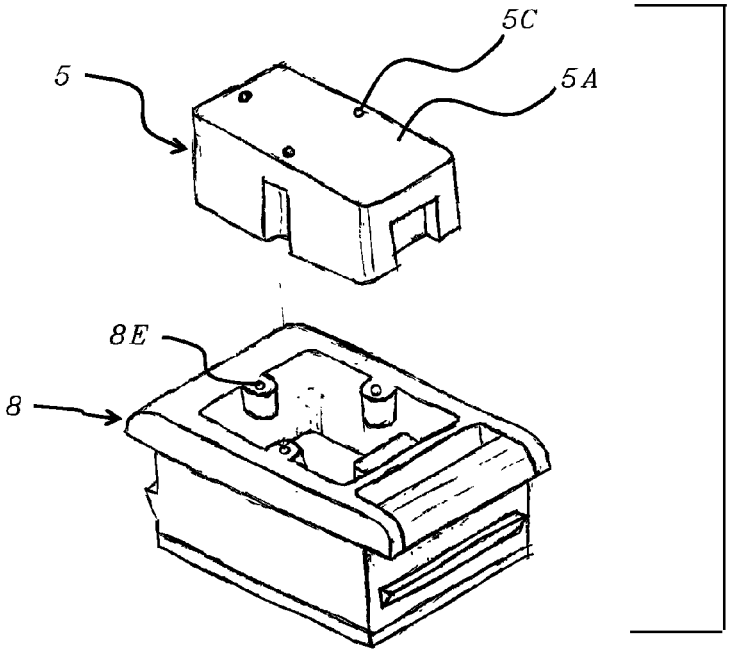
FIG. 10 is an isometric view of one embodiment of the plug portion comprising a housing and an insert for integrating functionality into the plug.

A further alternate embodiment, specifically adding to the plug 2 described in FIG. 4A, is the modular extendable plug 8 and the feature extension body 5 shown in FIG. 10. This embodiment may allow an added feature to be designed and manufactured by a third party or in-house and incorporated into a custom feature extension body 5, which may then be attached, such as by using mechanical fastening, glue, ultrasonic welding, and/or the like to the universal extendable plug 8E. The versions including a modular insert 5A and 8A may, in one implementation, be made of plastic or other rigid and durable material.

Optional Electrical Connections

Figure 11:
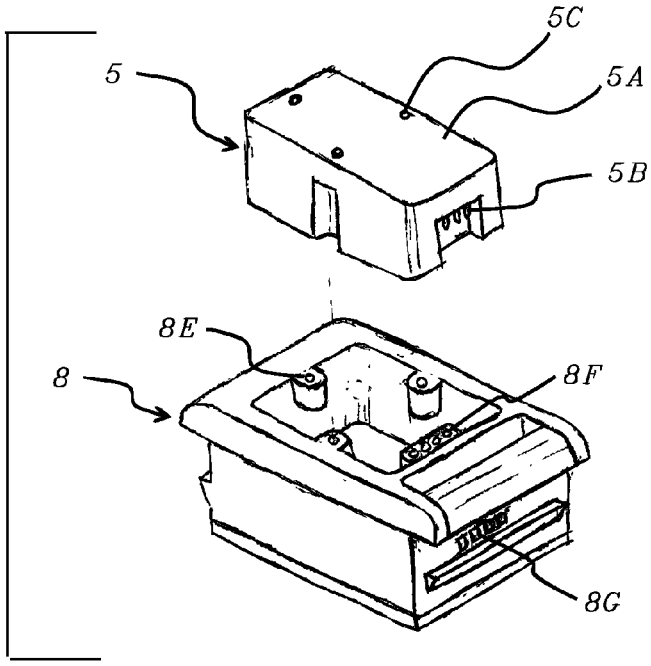
FIG. 11 is an isometric view of one embodiment of the plug showing a housing and insert for integrating functionality into the plug and containing electrical connectors for electrical interfacing between parts and the board.

An even further embodiment of the invention is the incorporation of electrical connections 5B, 8F, and 8G as depicted in FIG. 11. This may interface electrical components in the feature extension body 5, such as a microprocessor, power source, or data acquisition equipment, with electrical components located in that are installed in the receptacle and/or the glide board 1. Electrical connectors 8F may be directly connected to 8G, and/or connect electrical components embedded in the plug 8 with electrical connections 8F or 8G.

Figure 12:
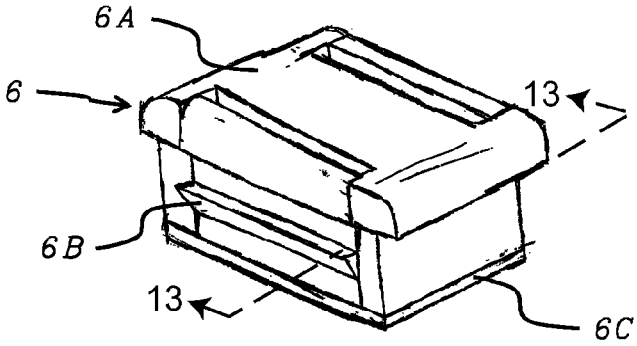
FIG. 12 is an isometric view of one embodiment of a plug in which both the male protrusions are latches that are retractable, transverse to the housing.
Figure 13:
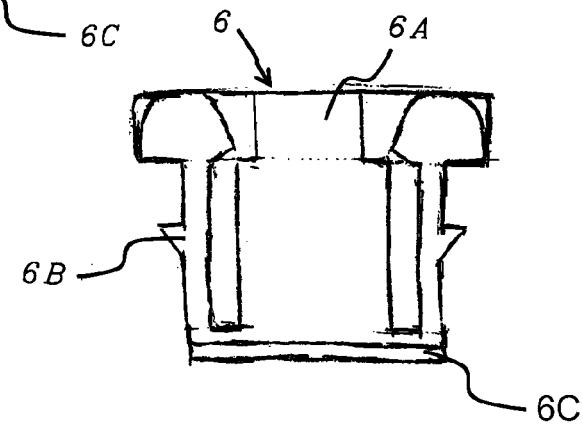
FIG. 13 is a side, cross-sectional view of the plug of FIG. 12, along the lines 13-13.
Figure 14:
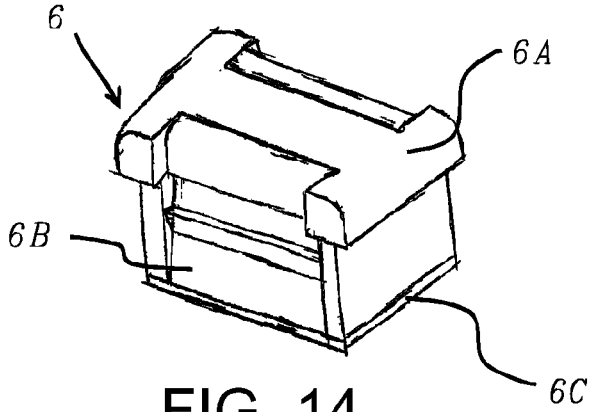
FIG. 14 is the unit and view of FIG. 12 with the male tabs in their retracted position.

FIGS. 12, 13, and 14 depict aspects of another embodiment of the plug 6, where both the male tabs 6B are retractable transverse to the longitudinal axis of the plug 6. FIG. 13 is a cross section of FIG. 12 along the lines 13-13 while FIG. 14 depicts the plug 6 with the male latch tabs 6B in the retracted state and ready for installation or extraction from the snowboard 1.

Figure 15:
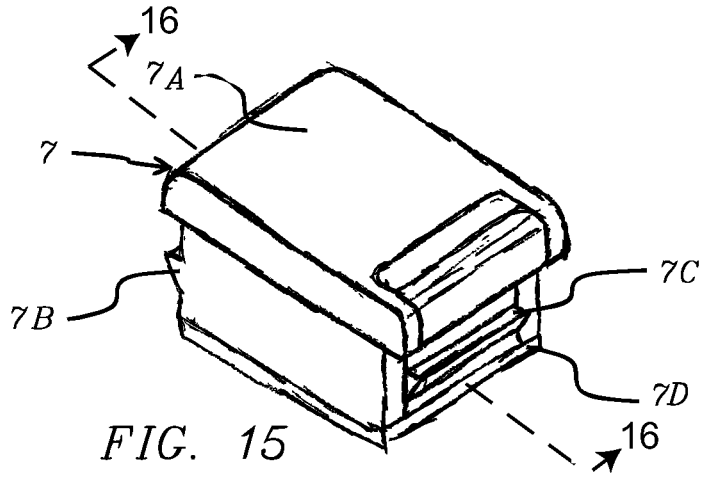
FIG. 15 is an isometric view of one embodiment of a plug in which a single male latch and button are an integral plastic component providing a spring effect by its deformation.
Figure 16:
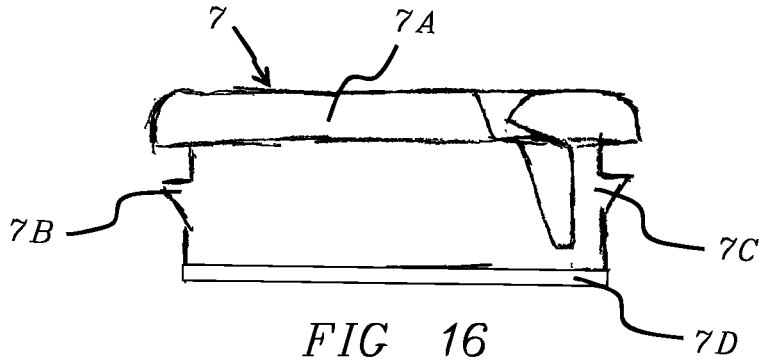
FIG. 16 is a side, cross-sectional view of the unit of FIG. 15 along the lines 16-16.
Figure 17:
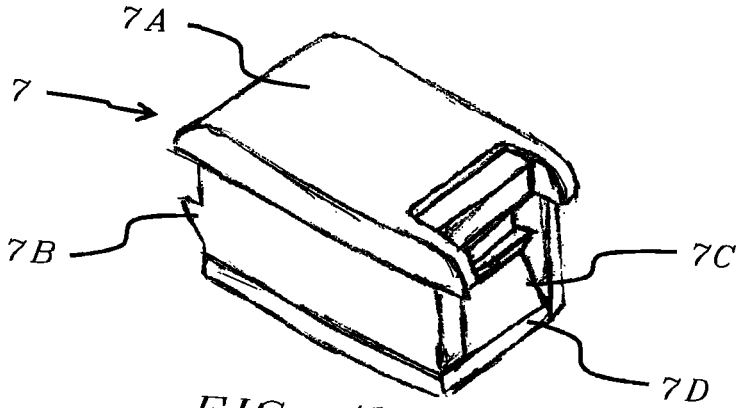
FIG. 17 is the unit and view of FIG. 15 with the snap-latch in its retracted position.

FIGS. 15, 16, and 17 depict another embodiment of the plug 7, where one male tab 7C is retractable inline to the longitudinal axis of the plug 7 using linear elastic deformation of the housing as a spring for the locking mechanism. This embodiment can be considered as a snap fit.

FIG. 17 depicts the plug 7 with the male retractable latch 7C in the retracted state and ready for installation or extraction from the snowboard 1.

Rooster Tail

FIG. 18, FIGS. 19A, 19B, 19C, 19D and FIG. 20 depict an accessory that provides for the creation of a rooster tail effect. FIG. 18 is a top view of the embodiment of a plug including a stabilizing retractable rooster tail duct 9E that penetrates the gliding surface 9E2 of the board 1, and collects and disperses the riding medium upward through the open channels 9E1.

FIG. 19A is a side view of the unit with the duct deployed; FIG. 19B shows a cross section along the lines 19B-19B of FIG. 18 illustrating the path the duct creates from the snow below the board to the air over the board. A lever 200 provides for retraction of the spring-loaded protrusion for removal of the plug from the receptacle. The duct 9E may be configured to pivot about the center of the pivot pins 9H, where the housing 9A may have holes in the sidewalls to accommodate the pivot pins 9H. Pivoting action may be reacted by a spring 9D that may immediately return the duct 9E to its non-retracted position in event of side or vertical load forcing the duct to retract. In one implementation, the compression spring 9D may be made of an all-weather elastomeric, a metal compression spring, rotational spring, and/or the like. In one implementation, the retractable duct 9E may be constructed of a low wear, low friction, and minimal water absorption material, all of which help prevent clogging, reduce drag and thus minimizing energy loss of medium passing through the duct 9E, optimizing dispersion height. The portion of the retractable duct 9E that penetrates the lower surface 9E2 of the glide board 1 may, in some implementations, be shaped in such a way, such as using rounded edges and chamfers, so that the duct 9E is retracted due to a force applied at any angle, forcing an upward rotation, due to impact with hard ice, park features such as rails, boxes, and/or the like. FIG. 19C shows a side view with the duct retracted restoring a flush surface at the bottom of the board. FIG. 19D is a perspective view of the unit of FIG. 18.

Figure 20:
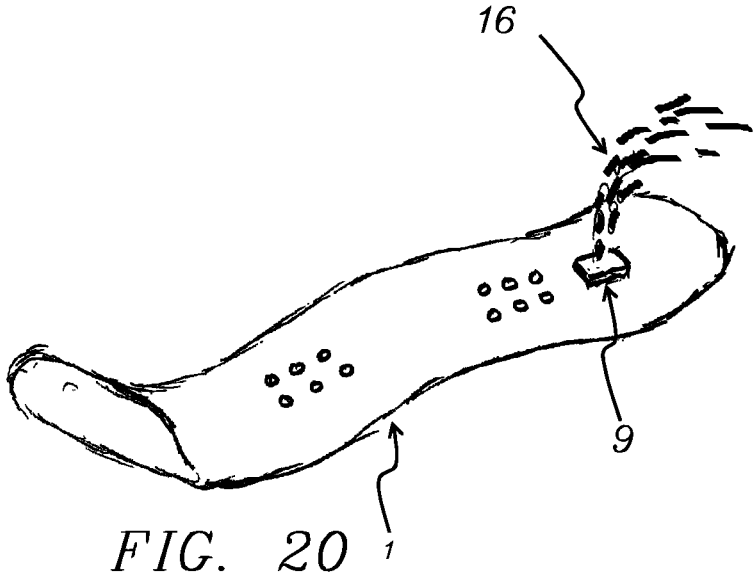
FIG. 20 is an isometric view of a snowboard with the plug of FIG. 18 installed; a rooster tail effect is depicted and is shown dispersing the snow upwardly.

FIG. 20 shows an isometric view of the glide board 1 with an embodiment of the plug 9 installed and depicts medium dispersion 16 in a rooster tail shape.

Figure 21:
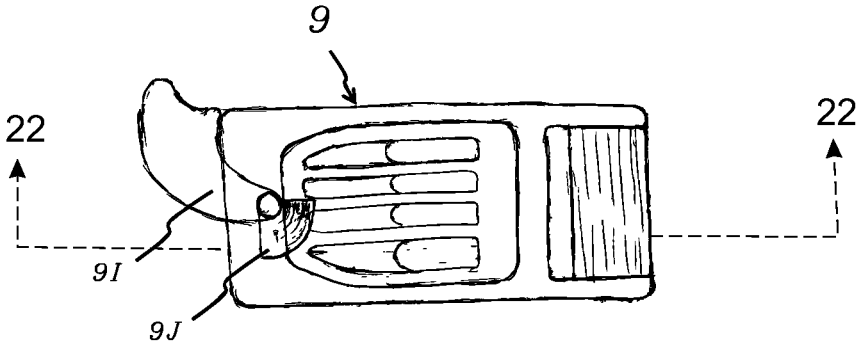
FIG. 21 is a top view of an alternative embodiment of a rooster tail plug and the rooster tail duct being manually retractable by way of a cam acting on the duct and activated by a rotating lever arm.
Figure 22:
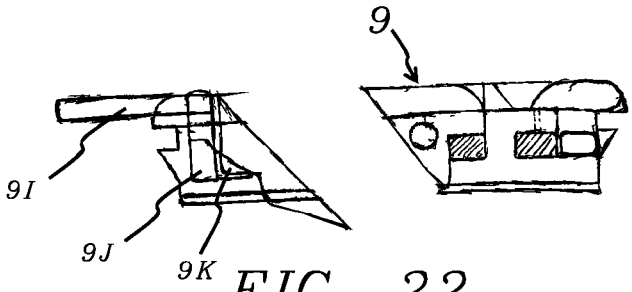
FIG. 22 is a side, cross-sectional view of the unit of FIG. 21. Along the line 22-22 depicting the rooster tail duct in its deployed position.
Figure 23:
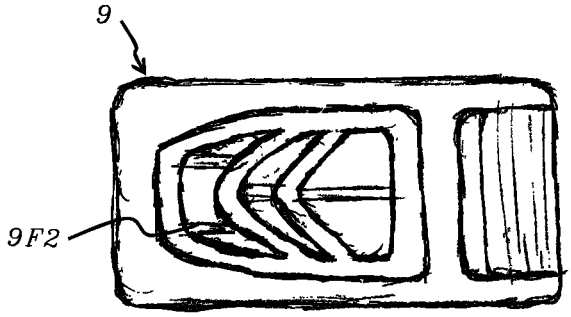
FIGS. 23-26 show plan views of alternate embodiments of a plug having a rooster tail duct depicting alternate contours of the duct that create unique dispersion effects.
Figure 24:
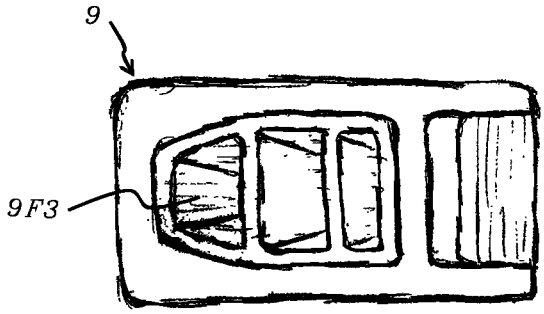
Figure 25:
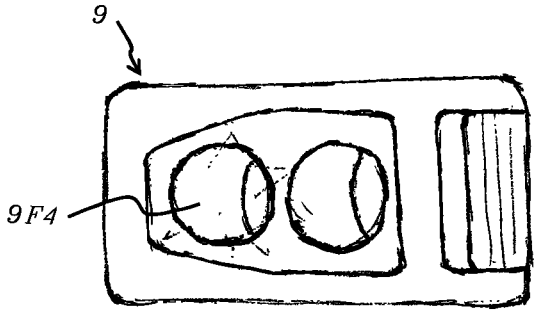
Figure 26:
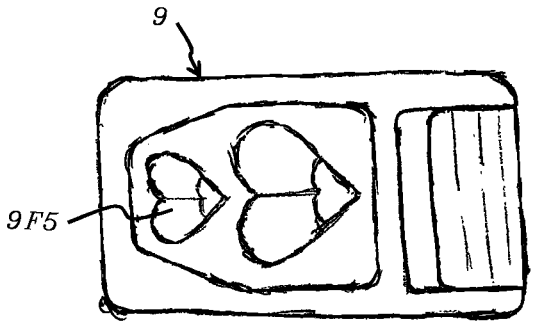

A further embodiment of the plug 9 with a retractable duct is depicted in FIG. 21 and FIG. 22. It adds the functionality to manually retract the duct 9E (shown in FIG. 18) by way of a lever 9I and cam 9J. A manual rotation of the lever 9I may slide the ramped cam under a notch 9K on the duct 9E, thus lifting the end of the duct 9E and locking the duct 9E in the fully retracted position. Opposite rotation of the lever 9I may lower the duct 9E into the down position. FIGS. 23-26 depict further embodiments of the retractable duct 9E where the shape of the channels 9F2 to 9F5 can be changed and create various effects of medium dispersion. The size, shape, and orientation of the channels can cause corresponding visual effects in the dispersed snow.

Retractable Fin

Figure 27:
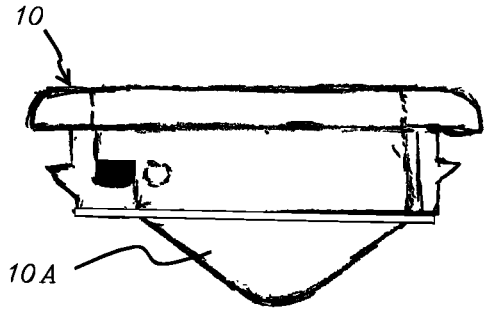
FIG. 27 is a side cross-sectional view of one embodiment of a plug with a retractable fin that penetrates the gliding surface of the board in the riding medium to add stability.
Figure 28:
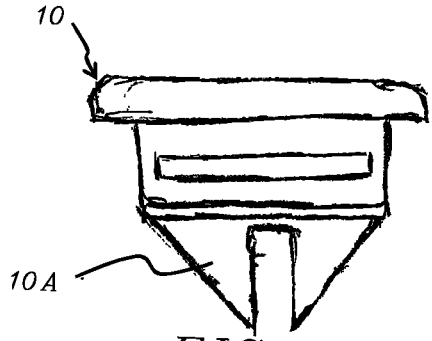
FIG. 28 is a front view the unit of FIG. 27.

FIGS. 27 and 28 depict an alternate embodiment of a plug In this version, the plug 10 has the added functionality of a single or multiple retractable fins 10A that penetrate the riding medium and are retractable in the same or similar fashion as described as the retractable duct 9E of FIGS. 18 and 19. The retractable fin 10A may increase stability, such as in the scenario where the fin 10A is on the opposite side of the board 1 of FIG. 1 to the direction of travel.

Figure 29:
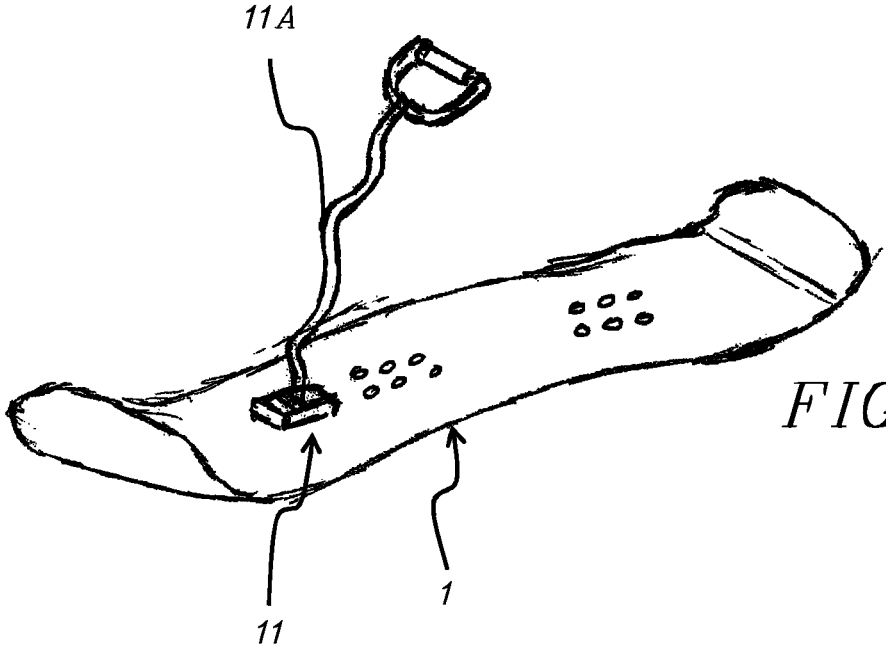
FIG. 29 is an isometric view of a glide board and containing a plug with the accessory functionality of a leash.

The drag force created by the fins 10A dragging in the medium may create a moment about the rider's center of gravity that may continuously force the fins and the rider's center of gravity to be collinear to the curvilinear path traveled, thus increasing stability. The more the fins 10A penetrate the riding medium with a larger projected area, the larger the drag force created and a larger moment forcing the fin to rotate the board about the rider's center of gravity, and as a result, the fin may remain directly in line with the rider and collinear to the traveled path, which might improve stability. FIG. 29 is an isometric view of one embodiment of the invention with the plug 11 installed in the glide board 1 and housing the additional functionality of a leash configured to be held by hand or strapped to a boot or leg.

Accessories

Figure 30:
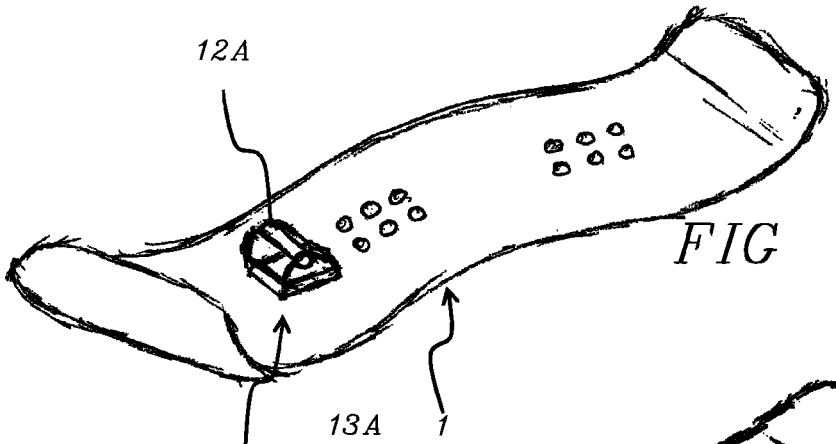
FIGS. 30-33 show isometric views of alternate embodiments of a plug installed in a glide board and containing the additional functionality, respectively.
Figure 31:
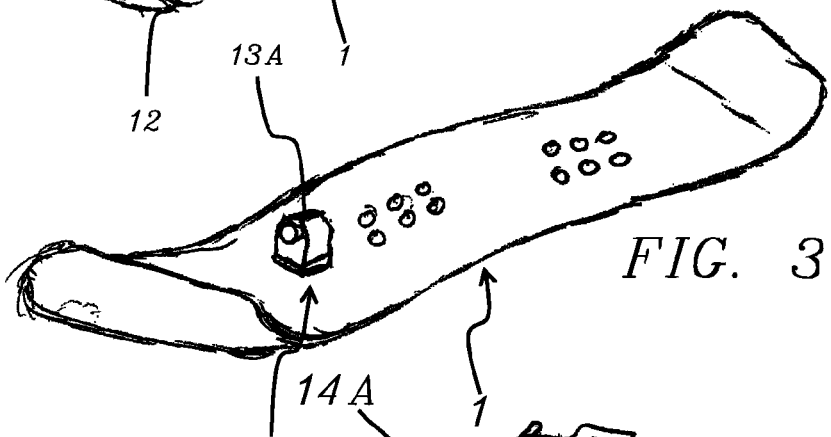
Figure 32:
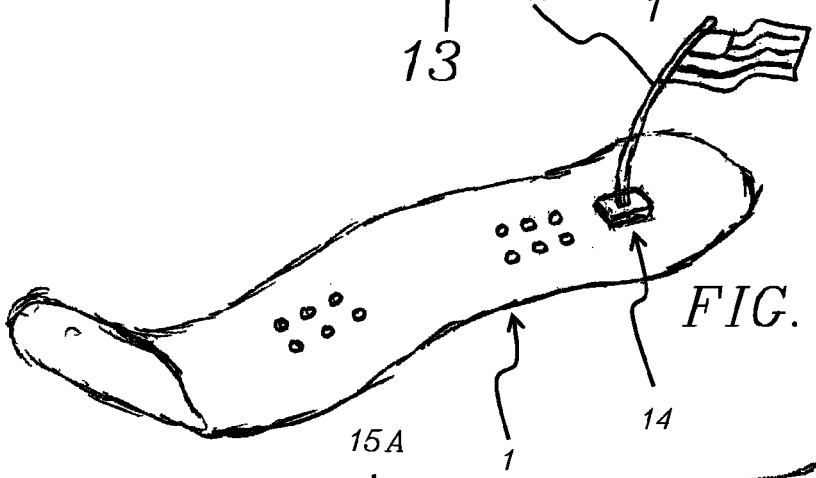
Figure 33:
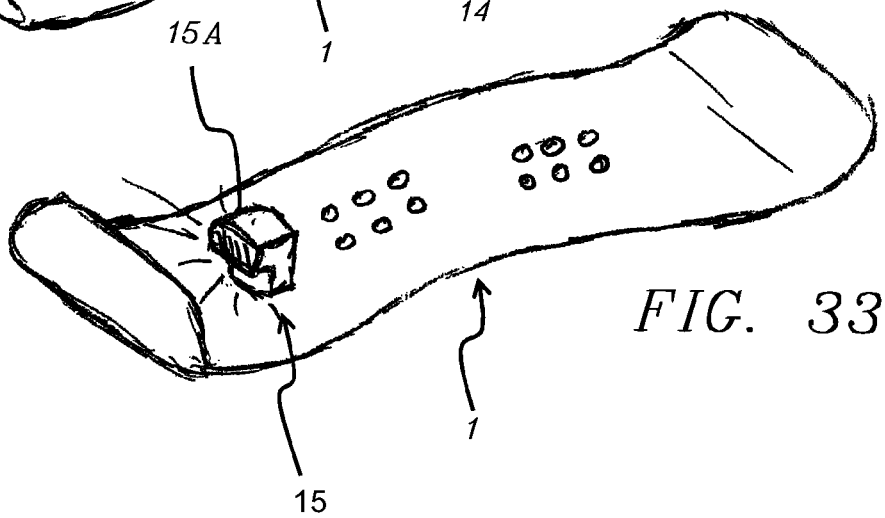

FIG. 30 is an isometric view of one embodiment of the invention with the plug 12 installed in the glide board 1 and containing the additional functionality of a handle grip 12A, such as for use in additional tricks performed during riding, for carrying the board over-the-shoulder while walking, and/or the like. FIG. 31 is an isometric view of one embodiment with the plug 13 installed in the glide board and containing the additional functionality of a still shot camera or video camera 13A. FIG. 32 is an isometric view of one embodiment of the invention with the plug 14 installed in the glide board 1 and containing the additional functionality of a flag 14A for identification during riding or for additional personalization. This embodiment is not limited to a flag 14A, but can also include a figurine, nameplate, sports team logo, and/or other form of personalization. FIG. 33 is an isometric view of one embodiment of the invention with the plug 15 installed in the glide board 1 and containing the additional functionality of a spotlight or other light 15A, such as for use during night riding that can light the way and allow the rider to be seen by other riders.

This embodiment is not limited to a spotlight 15A, but may also include a strobe light, flood light, and/or other light source, such as that may be self-powered by battery and/or electrically connected to a power source on the board 1, rider or other immediate location.

Alternate Versions

One alternate version is a system that has a fixed male latch portion in the receptacle and a releasable female portion in the plug.

Yet another embodiment includes a circular shaped receptacle and a plug with a circular base. The mating is via a threaded ¼ turn structure. In that embodiment a spring loaded pin in the plug finds a mating hole in the receptacle as the ¼ turn reaches its end position.

Figure 34:
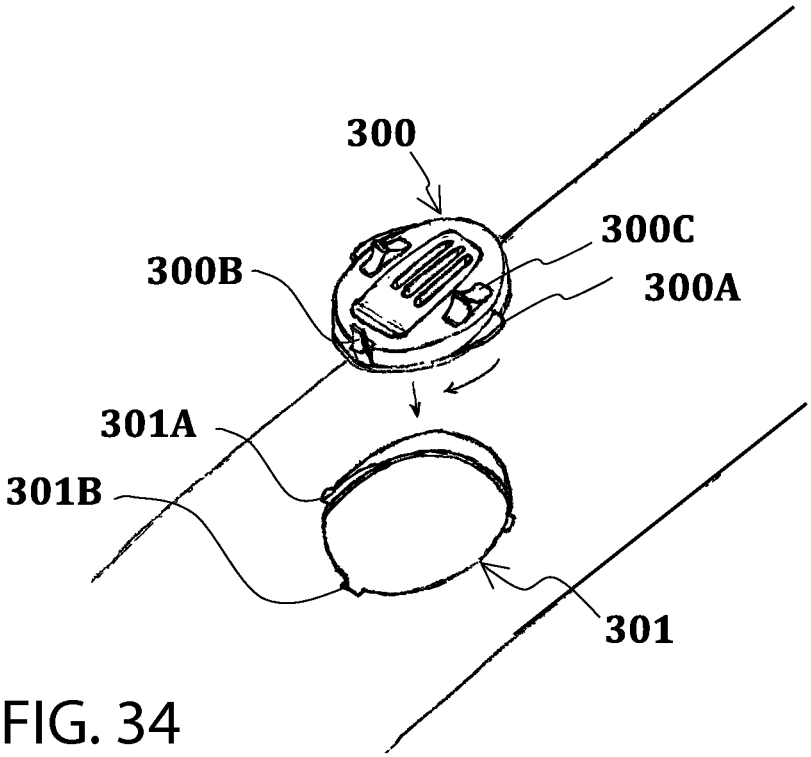
FIG. 34 shows a perspective view of an alternate circular embodiment.

FIG. 34 depicts another embodiment where the plug 300 is generally circular in shape and the receptacle 301 is generally a circular shaped recess. The plug is lowered into the receptacle and installed by a moiety of two or more quarter-turn male 300A and female 301A threads. To turn the plug into locking position, the user would push with two fingers, gloved or otherwise, against the raised tabs 300C. The plug is then locked in place to the receptacle to prevent rotation by a moiety of a male 300B and female 301B snap-fit.

Figure 35:
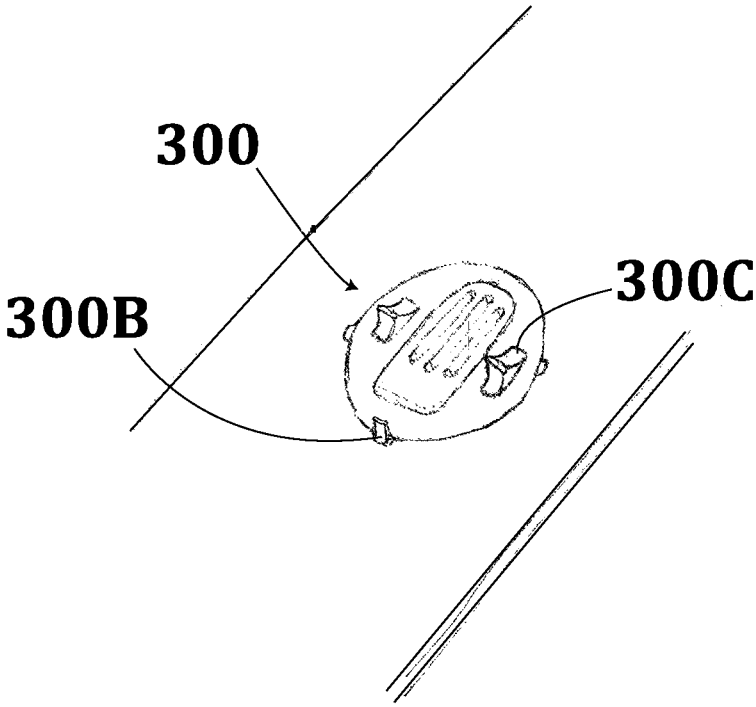
FIG. 35 shows the unit of FIG. 34 with a plug installed.

FIG. 35 depicts the embodiment described in FIG. 34 where the circular plug 300 is installed in the receptacle 301. To remove the plug from the receptacle, the user would push with two fingers, gloved or otherwise, against the raised tabs 300C and with a third finger, gloved or otherwise, retract the male snap-fit 300B which unlocks the plug and allows for quarter-turn rotation thus disengaging the plug from the receptacle.

Those skilled in the art will be aware of materials, techniques and equipment suitable to produce the example embodiments presented as well as variations on the those examples. This teaching is presented for purposes of illustration and description but is not intended to be exhaustive or limiting to the forms disclosed. Many modifications and variations will be apparent to those of ordinary skill in the art. The embodiments and versions help to explain the principles of the invention, the practical application, and to enable others of ordinary skill in the art to understand it. Various embodiments with various modifications as are suited to the particular application contemplated are expected.

In the following claims, the words "a" and "an" should be taken to mean "at least one" in all cases, even if the wording "at least one" appears in one or more claims explicitly. The scope of the invention is set out in the claims below.

It is claimed:

1. A plug for a receptacle, the receptacle located within the surface of a glide board, the plug comprising a lower surface having a portion that is a flat smooth layer of a material having the property of an effectively low absorption of water to be suitable to be in protracted contact with snow and also the property of an effectively low coefficient of friction with snow and configuration as to not substantially interfere with gliding during the plug's operation; further the plug having a side generally perpendicular to the horizontal plane adjacent the lower surface plane of its flat smooth layer portion; at least one side having a moiety of a latch mechanism located above the plane of the flat smooth portion of the lower surface at a predetermined distance above the flat portion for engaging with a mating latch in a glide board; the latch moiety being retractable for disengagement with its mating moiety by manual operation of a latch release from the upper side of the plug without tools.

2. The plug of claim 1 wherein the predetermined distance is a distance of about ½" above the plane of the flat smooth layer of the lower surface, and the latch is spring loaded.

3. The plug of claim 1 wherein the flat smooth surface covers substantially the entire bottom portion of the plug.

4. The plug of claim 1 wherein substantially all portions of the lower surface not comprising the flat smooth layer are comprised of a lower portion of a snowboard accessory.

5. The plug of claim 1 wherein substantially all portions of the lower surface are flush or inset from the plane of a corresponding glide board with receptacle or, optionally, are retractable when the mass of the rider is on_board such as to be effectively inset from that plane in operation.

6. The plug of claim 1 further comprising an integral snowboard accessory.

7. The plug of claim 1 further comprising a quick-connect attachment point for a snowboard accessory.

8. The plug of claim 6 wherein the snowboard accessory is a duct positioned to produce a rooster tail effect when in use.

9. The plug of claim 1 wherein the flat, smooth portion has a coefficient of friction with snow of between 0.1 and about 0.01.

10. The plug of claim 1 wherein the flat smooth portion has a coefficient of friction of about 0.04 or less with snow.

11. The plug of claim 8 wherein the lower smooth surface portion comprises a polypropylene.

12. The plug of claim 11 wherein the polypropylene is a UHMWPE.

13. A snowboard with a retractable duct located behind the rider's position; the duct shaped and configured as to, when in a deployed position where a leading, scooping, edge of the duct is below the bottom surface of the snowboard, and in use, scoops snow from below the snowboard, and to provide for the scooped snow to move through the snowboard and fly up into the air behind the snowboard.

14. The snowboard of claim 13 wherein the duct is spring-loaded to the deployed position and is self-retracting when the snowboard glides on an effectively hard surface with the mass of a rider on the board.

15. The snowboard of claim 14 wherein the duct's self-retracting is effected by gliding in both a forward and a rearward direction wherein the self-retracting is effectuated by the duct having a rear-facing oblique angle.

16. The snowboard of claim 14 wherein the lower portion of the duct is so shaped as to be self-retractable upon a sideways force via having a beveled shape.

17. The snowboard of claim 13 wherein the duct is readily removable from the snowboard without tools.

18. The snowboard of claim 13 wherein the duct has an inner structure comprising at least one partition such that the snow is emitted from at least two distinct orifices.

19. The snowboard of claim 18 where the at least one partition provides for the appearance of a decorative design at the duct's upper surface.

20. The snowboard of claim 18 where the at least one partition is so shaped and oriented as to channel a portion of the emitted snow in a distinct pattern from other portions of the emitted snow.

21. A glide board system comprising:

a generally planar glide board having a receptacle and a corresponding mating plug for said receptacle; the receptacle being substantially flush with the lower surface of the glide board in operation, the plug being readily releasable from the receptacle by a user without tools;

further, wherein at least one inner side wall of the receptacle has a moiety of latch mechanism; the plug having a flat smooth portion of its lower surface such that, when the plug is mated in the receptacle that flat smooth surface is flush with the lower surface of the glide board; further the plug having a latch moiety along a side wall complimentary to the latch moiety of the receptacle such that secure retention of the plug in the receptacle is provided for; and still further, the latch is readily disengage-able by manual action from the upper side of the plug, one handedly and without tools.

22. The system of claim 21 wherein the latch moiety located in the receptacle is a recess.

23. The system of claim 21 wherein the plug has at least one electrical contact and the receptacle has a corresponding mating electrical contact such that an electrical connection is made when the plug is mated in the receptacle.

24. The system of claim 21 wherein the plug is retained to the receptacle by a tab inserted in a first receptacle recess and a second, distinct retractable tab mating with a recess in a receptacle side opposed to that of the first recess.

25. The system of claim 21 wherein the plug is mated with the receptacle by a bayonet mount feature of the receptacle and a complementary feature of the plug.

* * * * *